US012397222B1

(12) United States Patent
Carruthers

(10) Patent No.: US 12,397,222 B1
(45) Date of Patent: Aug. 26, 2025

(54) PORTABLE TABLE STADIUM SYSTEM

(71) Applicant: Bruce Carruthers, Toronto (CA)

(72) Inventor: Bruce Alexander Carruthers, Toronto (CA)

(73) Assignee: Bruce Carruthers, Toronto (CA)

( * ) Notice: Subject to any disclaimer, the term of this patent is extended or adjusted under 35 U.S.C. 154(b) by 0 days.

(21) Appl. No.: 19/181,986

(22) Filed: Apr. 17, 2025

(51) Int. Cl.
*A63D 3/00* (2006.01)

(52) U.S. Cl.
CPC ..... *A63D 3/00* (2013.01)

(58) Field of Classification Search
CPC . A63D 3/00; A63F 7/00; A63F 7/0005; A63F 7/17; A63F 7/0017; A63F 7/0023; A63F 7/0616; A63F 7/07; A63F 2007/0011
USPC ..... 273/108, 108.1, 108.5, 108.52, 108.54, 273/118 R, 123 R, 127 R, 127 B
See application file for complete search history.

(56) References Cited

U.S. PATENT DOCUMENTS 3,463,490 A * 8/1969 Annessa ..... A63D 3/00 473/116
3,680,864 A * 8/1972 Peterson ..... A63F 9/16 273/108
3,703,287 A 11/1972 Smith
3,931,965 A 1/1976 Grant
4,033,585 A * 7/1977 Foreman ..... A63F 7/305 273/120 R
4,060,245 A * 11/1977 Gamez Duch ..... A63F 7/0668 273/108.5
4,179,122 A * 12/1979 Ray ..... A63F 7/0608 473/29
4,585,235 A * 4/1986 Williams ..... A63F 7/2409 273/357
4,702,478 A * 10/1987 Kruse ..... A63B 63/004 135/141

(Continued)

FOREIGN PATENT DOCUMENTS

CN 105521591 A 4/2016
DE 8631056 U1 3/1988

(Continued)

OTHER PUBLICATIONS

Pro Spin All-in-One Ping Pong Set—Retractable Ping Pong Net for Any Table, High-Performance Ping Pong Paddles, Pro-Quality Table Tennis Balls, Storage Case | Great Gift for Indoor & Outdoor Games https://www.amazon.ca/PRO-SPIN-Play-Anywhere-Portable/dp/B08DVFP5WQ?th=1.

*Primary Examiner* — Joseph B Baldori
(74) *Attorney, Agent, or Firm* — Stratford Group Ltd.

(57) ABSTRACT

Described are various embodiments of Portable Table Stadium System. In one embodiment, the system comprises one or more net assemblies, each net assembly comprising: a first goal post and a second goal post, each goal post configured to be removably secured to a table; a net coupled at a first end thereof to the first goal post, and at a second end thereof to a second goal post and extending therebetween. At least one support post per net assembly is disposed and secured to the table to engage with the net to provide vertical support thereto and to define at least in part an enclosed space on said table. Two goal posts proximate to one another are used to define a goal area. Some embodiments may include one or more accessories such as one or more bowling pins, obstacles and a ball.

18 Claims, 9 Drawing Sheets

(56) References Cited

U.S. PATENT DOCUMENTS

| | | | | |
|---|---|---|---|---|
| 4,850,590 | A * | 7/1989 | Lin | A63B 67/045 473/491 |
| 4,872,679 | A * | 10/1989 | Bohaski | A63F 7/0668 473/588 |
| 5,080,375 | A * | 1/1992 | Moosavi | A63B 63/004 473/478 |
| 5,092,595 | A * | 3/1992 | Daravina | A63F 7/0668 273/118 A |
| 5,413,340 | A * | 5/1995 | Potvin | A63B 63/004 273/400 |
| 5,423,537 | A * | 6/1995 | Santana | A63F 7/0668 273/129 R |
| 5,443,259 | A * | 8/1995 | Segan | A63F 7/0612 273/123 A |
| 5,713,807 | A | 2/1998 | Montaldi | |
| 5,769,744 | A | 6/1998 | Merrill et al. | |
| 5,785,313 | A * | 7/1998 | Shiraishi | A63D 3/00 273/108 |
| 6,082,736 | A | 7/2000 | Barlow | |
| D446,250 | S * | 8/2001 | Quiroga | D21/318 |
| 7,104,903 | B1 * | 9/2006 | Chen | A63B 67/045 473/492 |
| 7,147,225 | B2 * | 12/2006 | Navarro | A63F 7/06 273/242 |
| 7,178,802 | B2 * | 2/2007 | Nally | A63F 7/305 273/108 |
| 7,204,487 | B1 * | 4/2007 | Pohl | A63F 7/06 273/108.1 |
| 7,325,803 | B1 * | 2/2008 | Miranda | A63F 7/0668 273/108.41 |
| 8,182,374 | B1 | 5/2012 | Copeland | |
| 8,302,965 | B2 | 11/2012 | Grant | |
| 8,905,406 | B2 | 12/2014 | Brown | |
| 10,307,663 | B1 * | 6/2019 | Bates | A63F 7/0668 |
| 10,617,939 | B2 * | 4/2020 | Tsai | A63F 7/06 |
| 10,688,381 | B2 * | 6/2020 | Shindo | A63F 7/30 |
| 11,638,867 | B2 * | 5/2023 | Witherill | A63F 7/0616 273/317.1 |
| 2006/0205541 | A1 * | 9/2006 | D'Estais | A63B 67/045 473/491 |
| 2015/0091249 | A1 * | 4/2015 | Nally | A63F 7/0652 273/108.1 |
| 2017/0120126 | A1 | 5/2017 | Dmitruk | |
| 2020/0353346 | A1 * | 11/2020 | Antoine | A63F 3/00214 |
| 2024/0082694 | A1 * | 3/2024 | Skradski | A63F 7/0616 |

FOREIGN PATENT DOCUMENTS

| | | |
|---|---|---|
| EP | 0340027 | 11/1989 |
| FR | 284824 A1 | 6/2004 |
| GB | 267626 A | 3/1927 |

* cited by examiner

PORTABLE TABLE STADIUM SYSTEM

FIELD OF THE DISCLOSURE

The present disclosure relates to portable net assemblies, and, in particular, to a portable table netting stadium system.

BACKGROUND

Extensible nets are typically used for playing games such as ping pong, also known as table tennis nets. They are designed to be easily adjustable and portable. These nets can be attached to various types of tables, allowing you to set up a game almost anywhere.

This background information is provided to reveal information believed by the applicant to be of possible relevance. No admission is necessarily intended, nor should be construed, that any of the preceding information constitutes prior art or forms part of the general common knowledge in the relevant art.

SUMMARY

The following presents a simplified summary of the general inventive concept(s) described herein to provide a basic understanding of some aspects of the disclosure. This summary is not an extensive overview of the disclosure. It is not intended to restrict key or critical elements of embodiments of the disclosure or to delineate their scope beyond that which is explicitly or implicitly described by the following description and claims.

A need exists for a portable table stadium system that advantageously provides the ability to define an enclosed gaming area on tables of any shape and size, with one or more goal areas.

In accordance with a first aspect, there is provided a portable stadium system comprising: one or more net assemblies, each net assembly comprising: a first goal post and a second goal post, each goal post configured to be removably secured to a table; a net coupled at a first end thereof to said first goal post, and at a second end thereof to a second goal post and extending therebetween; and at least one support post per net assembly, each support post configured to be removably secured to said table and disposed as to engage with the net of one of said one or more net assemblies to provide vertical support thereto and to define at least in part an enclosed space on said table.

In some embodiments, at least one of said first goal post or second goal post comprises a tensioning mechanism configured to vary a length of said net therebetween.

In some embodiments, said tensioning mechanism comprises a reel for coiling said net therearound, the reel coupled to a tensioning wheel.

In some embodiments, at least of said first goal post or second goal post is removably attached to said net.

In some embodiments, each support post comprises a substantially elongated body comprising a plurality of protrusions extending laterally therefrom for engaging with one or more holes in said net.

In some embodiments, said substantially elongated body of said support post is configured to be rotatable around an axis defined by a length thereof.

In some embodiments, said support post comprises a clamping portion and wherein said substantially elongated body is offset with respect to said clamping portion so as to be above a surface of said table upon the support post being removably secured.

In some embodiments, the system further comprises two or more net assemblies; wherein each net assembly of said two or more net assemblies has one goal post of said first or second goal post disposed proximate another goal post of said first or second goal post of another net assembly of said two or more net assemblies, thereby defining a goal area therebetween.

In some embodiments, the system comprises three or more net assemblies, thereby defining correspondingly three or more goal areas.

In some embodiments, the system comprises a single net assembly, thereby defining correspondingly a single goal area.

In some embodiments, the system further comprises: a cross-bar having a substantially elongated body, and configured to be removably coupled at a first end thereof to an upper portion said one goal post and at a second end thereof to an upper portion of said another goal post.

In some embodiments, the cross-bar is extensible.

In some embodiments, the cross-bar comprises a scoring tracker.

In some embodiments, the cross-bar further comprises a rigid frame defining a goal volume; and a stretchable goal net coupled to said rigid frame enclosing said goal volume.

In some embodiments, the system further comprises: one or more bowling pin accessories; and at least one obstacle accessory.

In some embodiments, at least one of said one or more bowling pin accessories is configured to have a resistance to being knocked down upon being impacted modified.

In some embodiments, said resistance to being knocked down is changed by attaching a support disk at the bottom thereof.

In some embodiments, the at least one of said one or more bowling pin accessories comprises an internal cavity, wherein said resistance to being knocked down is modified by filing said cavity with a material.

In some embodiments, the at least one obstacle accessory is substantially cylindrically shaped and comprises a concave top surface. Other aspects, features and/or advantages will become more apparent upon reading of the following non-restrictive description of specific embodiments thereof, given by way of example only with reference to the accompanying drawings.

BRIEF DESCRIPTION OF THE DRAWINGS

Several embodiments of the present disclosure will be provided, by way of examples only, with reference to the appended drawings, wherein.

Figure 1:
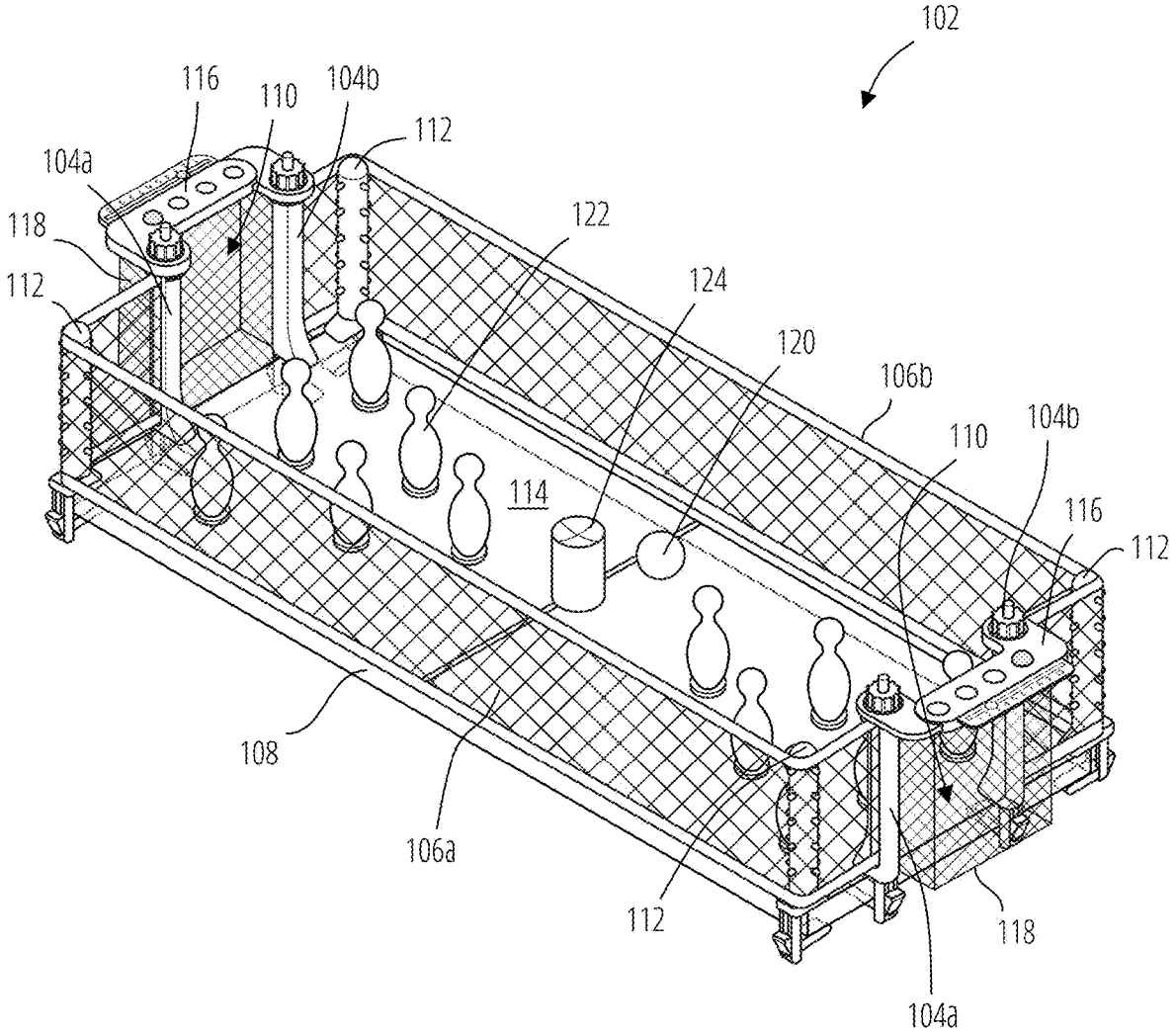
FIG. 1 is a perspective view of a portable table stadium system, in accordance with one embodiment.

Elements in the several drawings are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiments are often not depicted in order to facilitate a less obstructed view of these various embodiments of the present disclosure.

DETAILED DESCRIPTION

Various implementations and aspects of the specification will be described with reference to details discussed below. The following description and drawings are illustrative of the specification and are not to be construed as limiting the specification. Numerous specific details are described to provide a thorough understanding of various implementations of the present specification. However, in certain instances, well-known or conventional details are not described in order to provide a concise discussion of implementations of the present specification.

Furthermore, numerous specific details are set forth in order to provide a thorough understanding of the implementations described herein. However, it will be understood by those skilled in the relevant arts that the implementations described herein may be practiced without these specific details. In other instances, well-known methods, procedures and components have not been described in detail so as not to obscure the implementations described herein.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C."

The system and method of the present disclosure provide examples, in accordance with different embodiments, of a portable stadium system that provides one or more net assemblies and support posts that allows to turn any table surface into an enclosed gaming area or surface. The system comprises one or more net assemblies, each comprising a pair of goal posts having an extensible net therebetween, that are deployed along the perimeter of any table. Two or more pairs of such goal posts can be affixed to any table to form correspondingly two or more open goal areas therebetween. The support poles are similarly affixed to the table and provide vertical support for the extended nets. This provides an efficient means of deploying the nets along the perimeter of the table and to closely circumscribe the play area within the table surface. This advantageously allows the extended nets to be deployed on any type of table, including many shapes and sizes, as will be shown below.

FIG. 1 shows an exemplary non-limiting embodiment of the portable table stadium system 102 during play. This example uses only two pairs of goal posts 104*a* and 104*b*, each pair having an extensible net (106*a* or 106*b*) deployed therebetween For added clarity, each pair of goal posts and the extensible net therebetween are labeled with a same letter. Therefore, the pair of goal posts 104*a* comprise an extensible net 106*a* therebetween, while the second pair of goal posts 104*b* comprise a corresponding extensible net 106*b* therebetween. In this example, each net post in a same pair are removably affixed to an opposite end of the table 108. For a given end, the combination of a goal post 104*a* from the first pair and a goal post 104*b* from the second pair defines a goal area 110 therebetween. To vertically support the extensible nets 106*a* and 106*b* over the length of the table, one or more support posts 112 are provided. The number of support posts 112 used depends on the size and shape of the table. For a rectangular table, such as the one illustrated in FIG. 1, four support posts 112 are enough to fully circumscribe the edges of the table and define a play area 114. Additional examples using additional support posts, and additional goal posts as well, will be discussed below.

Also included in this example are extensible goal cross-bars 116 that can be installed over the top portion of the goal posts 104*a* and 104*b*. The desired length of each goal cross-bar 116 can be adjusted to accommodate the width of the goal area 110, and further provides support for an attachable goal net 118 that prevents objects from falling off the table surface during play.

It will be appreciated by the person skilled in the art that the play area created on the table surface with the goal posts and support posts of system 102 can be used to play a plurality of different games, without exception. In some embodiments, additional play accessories may also be included with the goal posts and support posts. FIG. 1 illustrates such a non-limiting example where the system further comprises accessories like a ball 120, a plurality of bowling pins 122, and at least one heavy obstacle 124. The goal of the game is to project the ball 120 (via a finger flick or similar) over the table surface in the direction of the opposing team's goal area. Bowling pins 122 represent "players" that provide obstacles that can be bounced from and/or knocked over with the ball (removing them from the play surface), while the obstacle 124 is the "referee" located in the middle. The obstacle 124 is heavy and stable enough so as to not be knocked over when impacted with the ball, and in this example prevents the players from shooting the ball in a straight line across the play area. It will be appreciated that a different number of bowling pins 122 and obstacles 124, and different configurations thereof, can be used than those illustrated, without limitation. In addition, the bowling pins 122 can include variably weighted bowling pins.

Figure 2A:
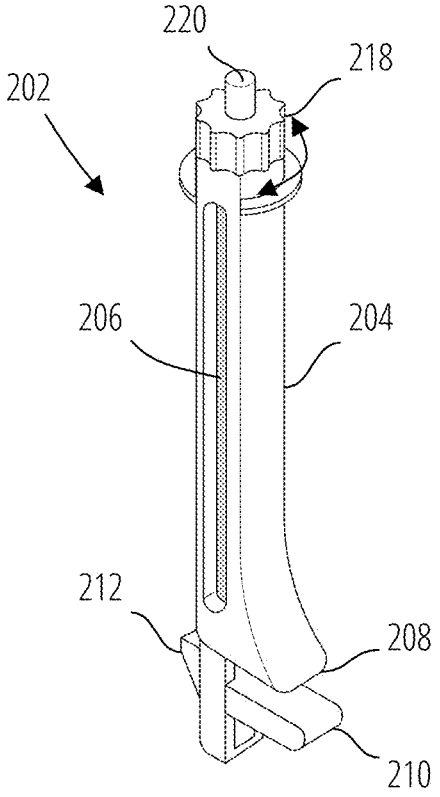
FIG. 2A and FIG. 2B are perspective views of a goal post of the portable stadium system of FIG. 1, in accordance with one embodiment.

FIG. 2A shows an exemplary goal post 202, in accordance with one embodiment. In this example, goal post 202 (of a pair of goal posts of the net assembly) comprises a substantially elongated body 204 comprising a slot 206 along the length thereof which allows the extensible net to be extended therefrom. In this example, the goal post 202 comprises, as an example only, a push down and spring tension foot style clamp. This is incorporated by having the elongated body 204 comprising at a lower end thereof an flat lower portion 208, which is designed to lay over the table surface, while a movable lower clamp member 210 is adjusted to securely attach or secure the goal post to the table. A release button 212 is provided to easily detach the goal post from the table. Other embodiments may use different clamp designs or attachment means known in the art, without limitation. A lip 214 is also provided to support a goal cross-bar.

Figure 2B:
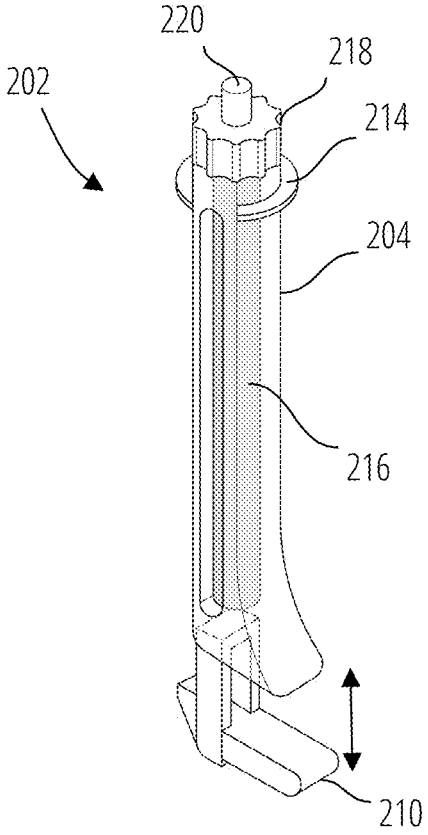

In some embodiments, a netting tensioning mechanism may be provided as well. For example, FIG. 2B shows a partial see-through view of the elongated body comprising therein a goal post may comprise a reel 216 coupled to an end of the net, allowing the net to be extended or coiled to increase tension. The reel 216 may be coupled with a ratcheting mechanism comprising a pawl and a spring (not shown) that allow for ratcheting of the perimeter netting when turning a tensioning wheel or crank 218. A tension release button 220 is provided to release the pawl and decrease tension. It will be appreciated that different ratcheting mechanisms or configurations may be used, without limitation. In some embodiments only one of the two goal posts in a same pair may comprise the tensioning mechanism. In those embodiments, the reel 216 in one of the goal posts is not connected to a ratcheting mechanism, but instead allowed to turn freely. A non-tensionable goal post will also not require the tensioning wheel or release button.

Figure 3A:
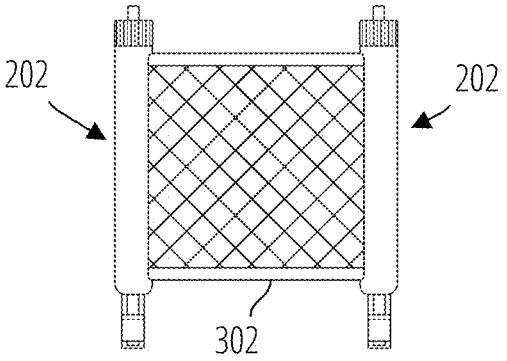
FIG. 3A and FIG. 3B are front views of a net assembly comprising a pair of goal posts having a net extended at different lengths, in accordance with one embodiment.
Figure 3B:
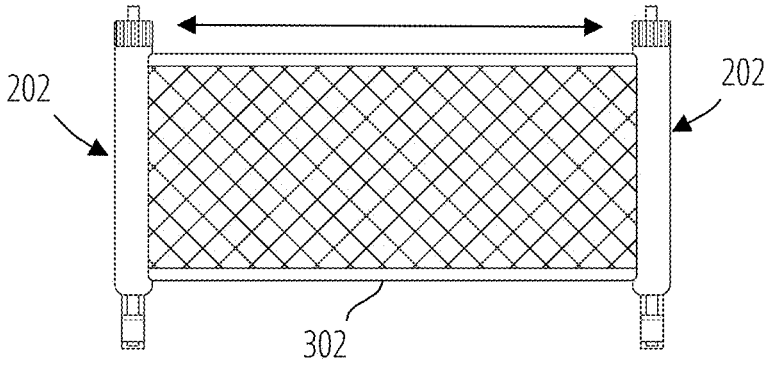

FIG. 3A and FIG. 3B show examples of how the net 302 can be extended between the pairs of goal posts 202. The height of the goal posts 202 and the net 302 should be large enough to avoid play accessories from falling off the table, while the length of the net 302 should be long enough to accommodate half the perimeter of a common dinner table or the like. It will be appreciated that different goal posts with different dimensions may be provided, to accommodate different needs/requirements.

Figure 3C:
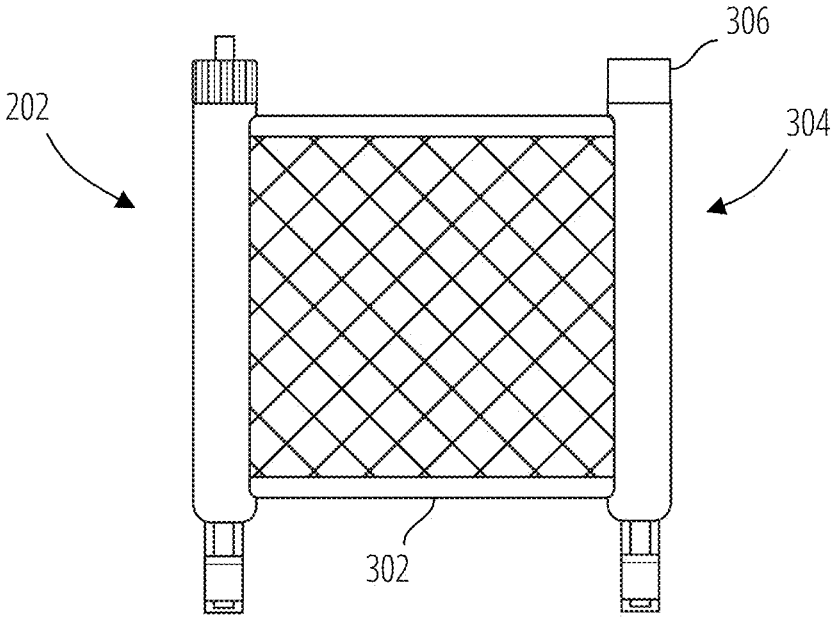
FIG. 3C is a front view of a net assembly comprising a goal post permanently affixed to the net, in accordance with one embodiment.
Figure 3D:
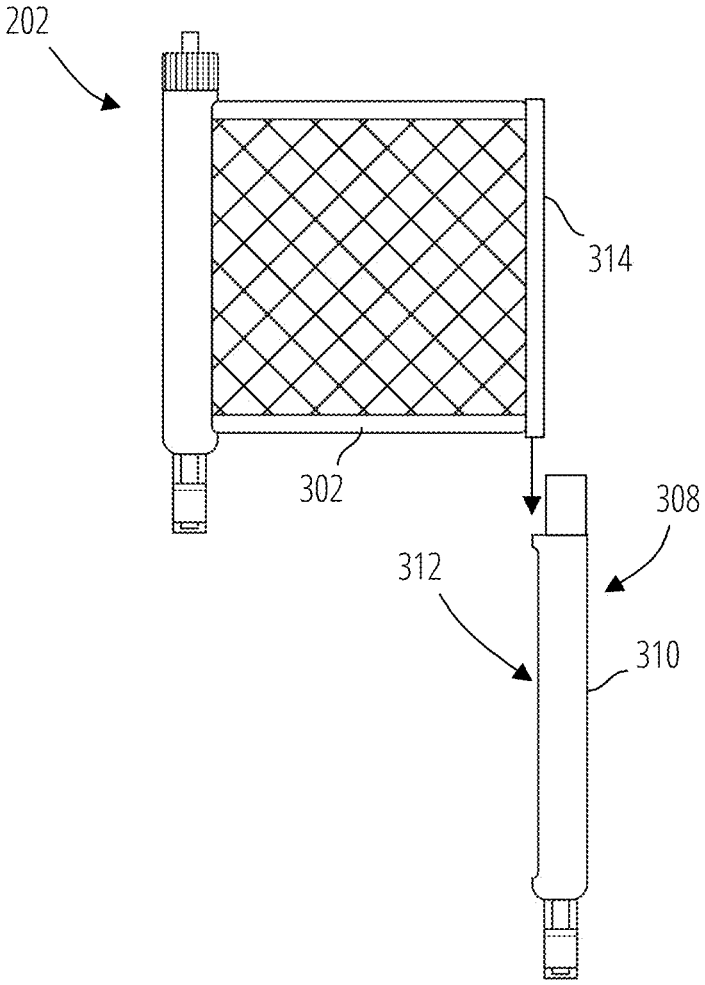
FIG. 3D is a front view of a net assembly comprising a goal post having a slot to removably attach an end of the net thereto, in accordance with one embodiment.

FIG. 3C and FIG. 3D show two exemplary embodiments where only one of the two goal posts comprises a tensioning mechanism. In the example of FIG. 3C, the net 302 is permanently secured to the goal post 304. Any means known in the art to secure the net to the goal post may be considered, without exception. A top portion 306 is similarly shaped to the tensioning wheel 218 so as to provide engagement with the goal cross-bar. In the example of FIG. 3D, the net assembly comprises a goal post 308 having a body 310 comprising a slot 312 along the length thereof for receiving an elongated member 314 shaped and configured to be slidingly secured therein. In this example, the slot 312 may be similar to the one illustrated in FIG. 3A but would extend all the way to the top. It will be appreciated that other types of attachment mechanisms may be considered as well.

Figure 4A:
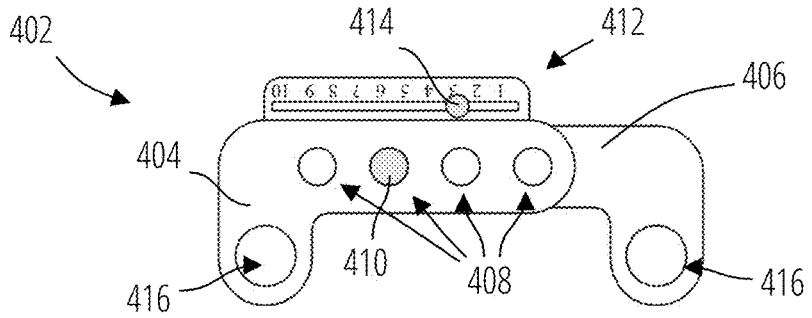
FIGS. 4A-4D are different views of a cross-bar in various configurations, in accordance with one embodiment.
Figure 4B:
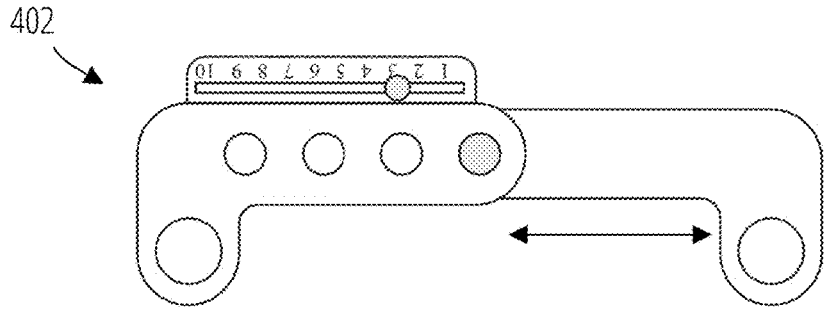

The enclose the upper portion of the goal area, a cross-bar is provided that can be attached to the goal posts therebetween. This cross-bar can have a fixed pre-determined length, or can in some examples be extensible. FIGS. 4A-4D provide different views of an extensible goal cross-bar 402, in accordance with one embodiment. FIG. 4A and FIG. 4B show an exemplary C-shaped goal cross-bar 402 comprising a first portion 404 and a second portion 406 slidingly coupled to one another. This exemplary goal cross-bar 402 is configured to be extensible to accommodate different goal area widths. In this non-limiting example, a plurality of holes 408 on the first portion 404 are provided that can be engaged with a rounded spring-loaded protrusion 410 on the second portion 406. This allows the length of the goal cross-bar 402 to be adjusted and locked. Pressing the spring-loaded protrusion 502 unlocks the mechanism and the length may be changed once more. The number and size of the holes 408 is only exemplary and different configurations may be used instead. In addition, a scoring tracker 412 is also provided to help track score for each team. In this example the scoring tracker 412 comprises a slider 414 but other embodiments may use any other means known in the art, including electronic displays.

Figure 4C:
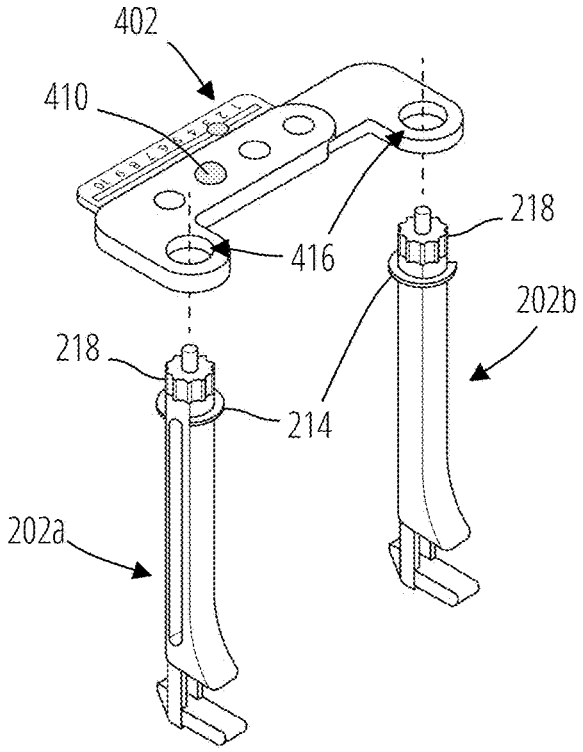

FIG. 4C illustrates how the goal cross-bar 402 may be slidingly engaged on the top of two goal posts 202*a* and 202*b* (from different pairs) to rest on a lip portion 214 thereof. Two holes 416 are sized so as to be engageable over the tensioning wheels 218 (if present) but small enough so the goal cross-bar 402 can rest on the lips 214 of the goal posts.

Figure 4D:
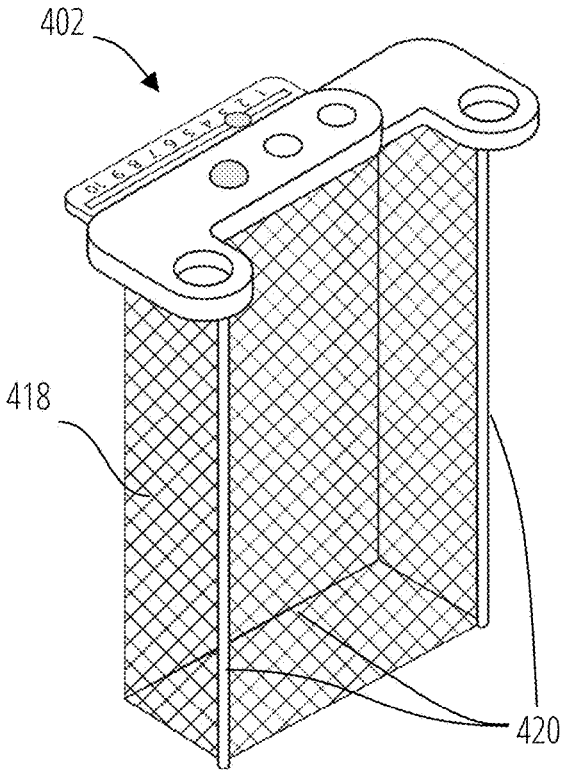

FIG. 4D shows an exemplary extensible net 418 that can be attached to the goal cross-bar 402. The netting of the extensible net 418 should be made of resilient and elastic threads to stretch when the cross-bar is elongated. A rigid frame 420 defining a goal volume may also be provided to ensure that the extensible net 418 enclosing the volume retains its shape and prevents a ball or other object from falling off the table when entering the goal area.

Figure 5A:
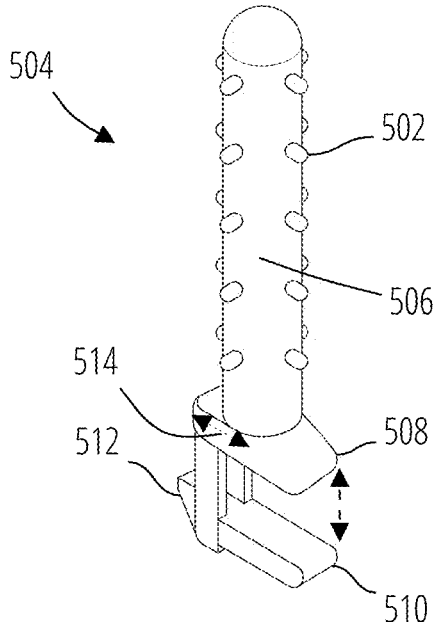
FIG. 5A and FIG. 5B are perspective views of a support post, in accordance with one embodiment.
Figure 5B:
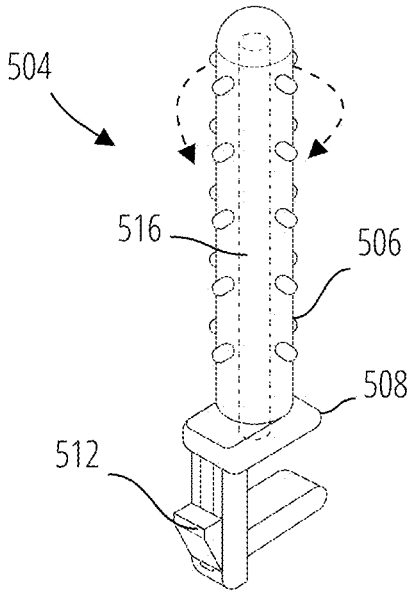

FIG. 5A and FIG. 5B provide views of a support post 504, in accordance with one embodiment. In this example, the support post comprises a substantially elongated body 506 that is higher than the height of the perimeter netting. A plurality of protrusions 502 are disposed along the length of the body 506. These are sized, shaped and disposed so as to easily engage the perimeter netting, thereby providing vertical support. The protrusions 502 may include bumps and/or spikes as well. Different shapes may be used simultaneously on a same support post. This specific example includes four linear arrays of protrusions along opposing sides.

The support posts further comprises an attachment mechanism. In this example, the support post 504 comprises a clamp mechanism comprising a fixed upper clamp portion 508, which is coupled to a moveable lower clamp portion 510. Similarly to the goal posts discussed above, the movable lower clamp portion 510 comprises a release button 512 which provide a quick way to detach the support post from the table. Other embodiments may use different clamping or attachment mechanism, without limitation. Moreover, the body 506 is offset 514 forward with respect with the clamp so that the support post is located above the table surface when attached, which avoids creating gaps in which the ball or other objects might fall.

In some embodiments, as shown in FIG. 5B, instead of being coupled to the upper clamp portion 508 directly, the elongated body 506 of the support post 504 may be rotatably mounted on a fixed elongated member 516. This allows the body 506 of the support post 504 to freely roll or rotate around an axis defined by its length, which avoids the perimeter netting from getting caught in the protrusion when tension is adjusted (the body 504 simply rolls and allows the netting to move).

Figure 6A:
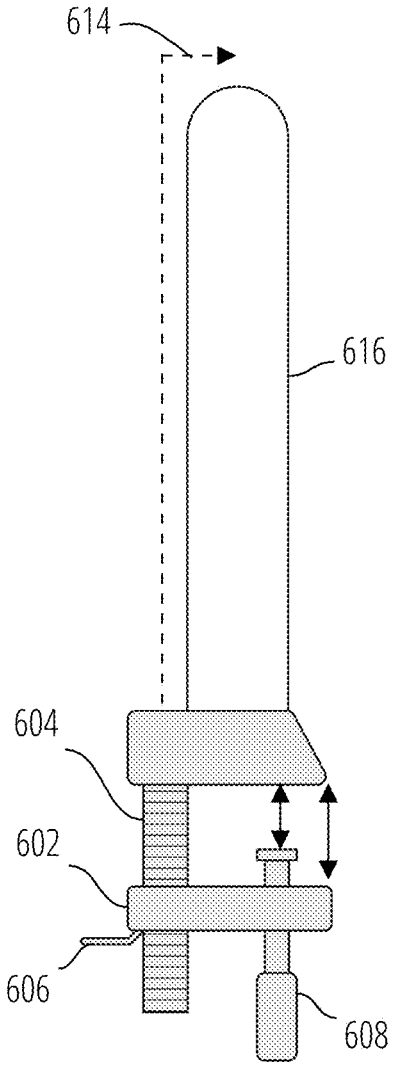
FIG. 6A and FIG. 6B are side views illustrating different clamping mechanisms for the support posts, in accordance with one embodiment.
Figure 6B:
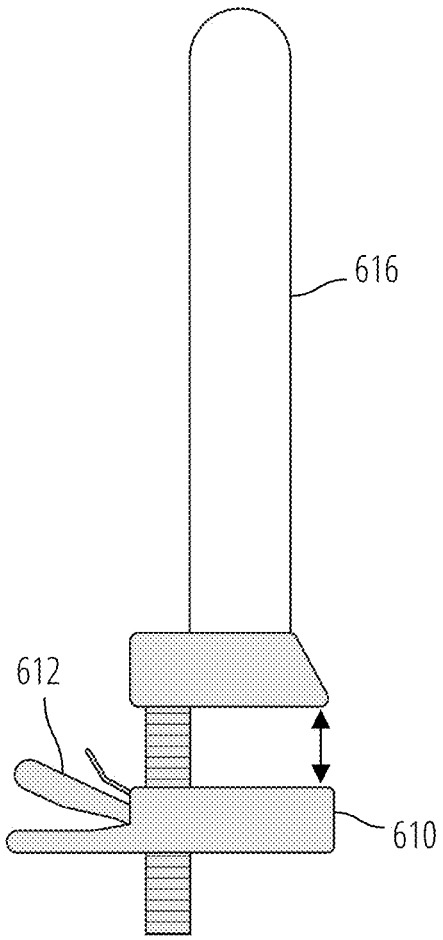

FIG. 6A and FIG. 6B show examples of clamping mechanisms that can be used with the goal posts and/or support posts, in accordance with two embodiments. FIG. 6A comprises an adjustable member 602 coupled to a bar 604 with notches. The member 602 comprises a ratchetting mechanism coupled to a release lever 606. A tightening screw 608 with a rubber-like tip is engaged within the member 602 and can be extended to secure the clamp on a table. FIG. 6B shows a quick release design comprising a well-known Irwin style clamp having a ratcheted movable member 610 coupled to a grip 612 that ratchets the member 610 upon the grip being engaged. Also illustrated in FIG. 6A is the forward offset 614 of the substantially elongated member 616 of the support post with respect to the clamp position, ensuring that the support post is always above the table surface so as to not create gaps in the enclosure. It will be appreciated that the illustrated exemplary clamping mechanisms of FIGS. 6A and 6B may be used on the goal posts as well, without limitation.

Figure 7A:
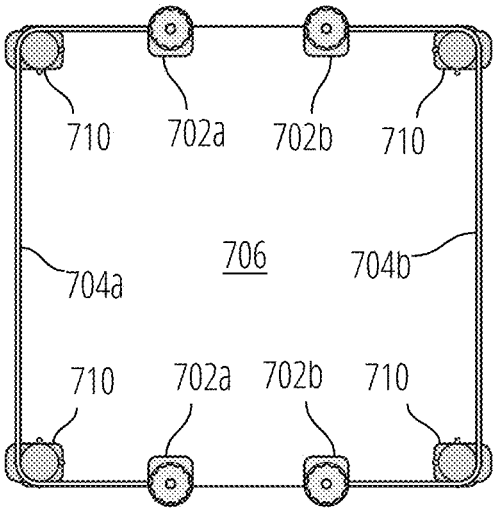
FIGS. 7A-7D are top views of the portable stadium system comprising two net assemblies installed on a square (FIG. 7A), rectangular (FIG. 7B), circular (FIG. 7C) and oval (FIG. 7D) table, in accordance with one embodiment.
Figure 7C:
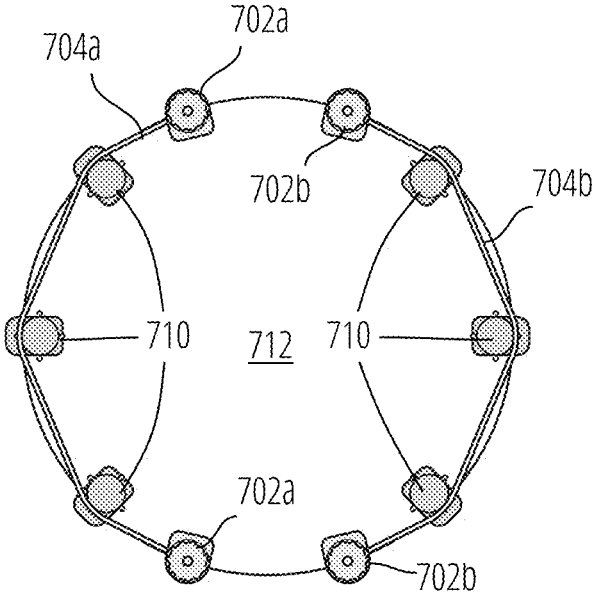
Figure 7B:
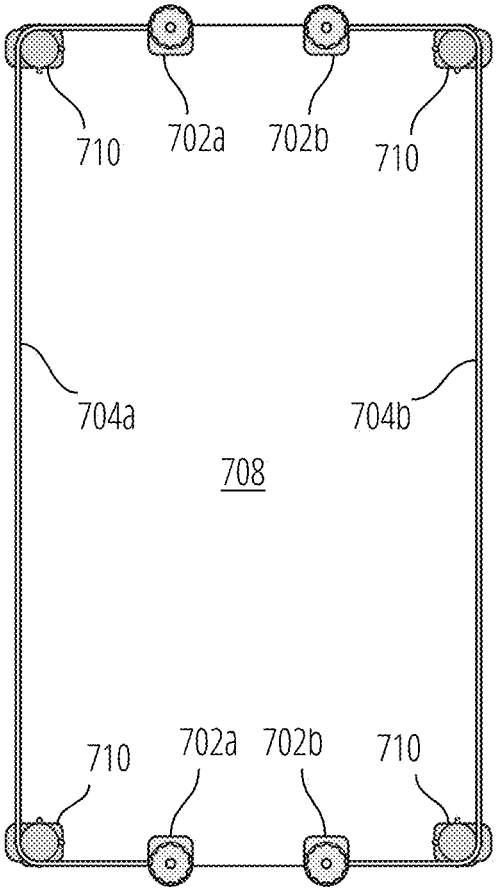
Figure 7D:
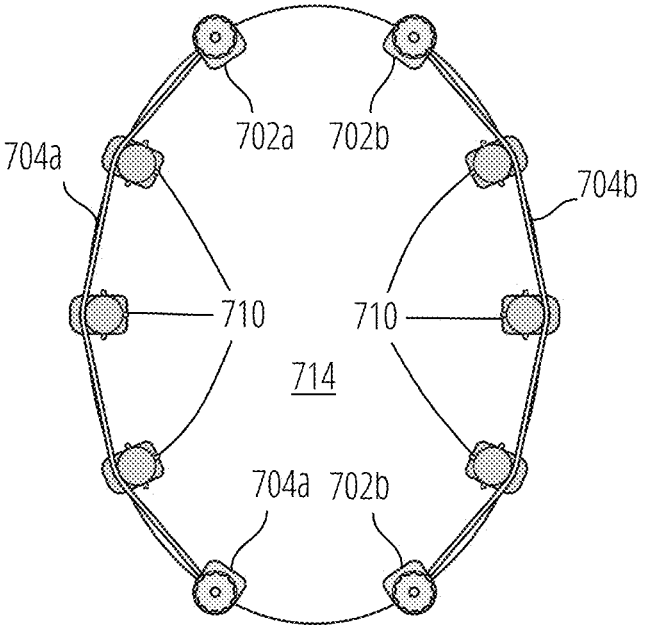

FIGS. 7A-7D provide examples illustrating how the portable table stadium netting system can be efficiently configured to accommodate different table sizes and shapes. All these examples use the same two pairs of goal posts 702*a* and 702*b*, each pair coupled to the extended nets 704*a* and 704*b*. FIG. 7A and FIG. 7B show how square (706) and rectangular (708) tables, respectively, may be accommodated with four support posts 710, while FIG. 7C and FIG. 7D show how round (712) and oval (714) tables, respectively, can be accommodated with six support posts 710. It will be appreciated that additional support posts may further be used to circumscribe more complex table shapes. In these examples, the goal cross-bar was omitted for added clarity.

Figure 8:
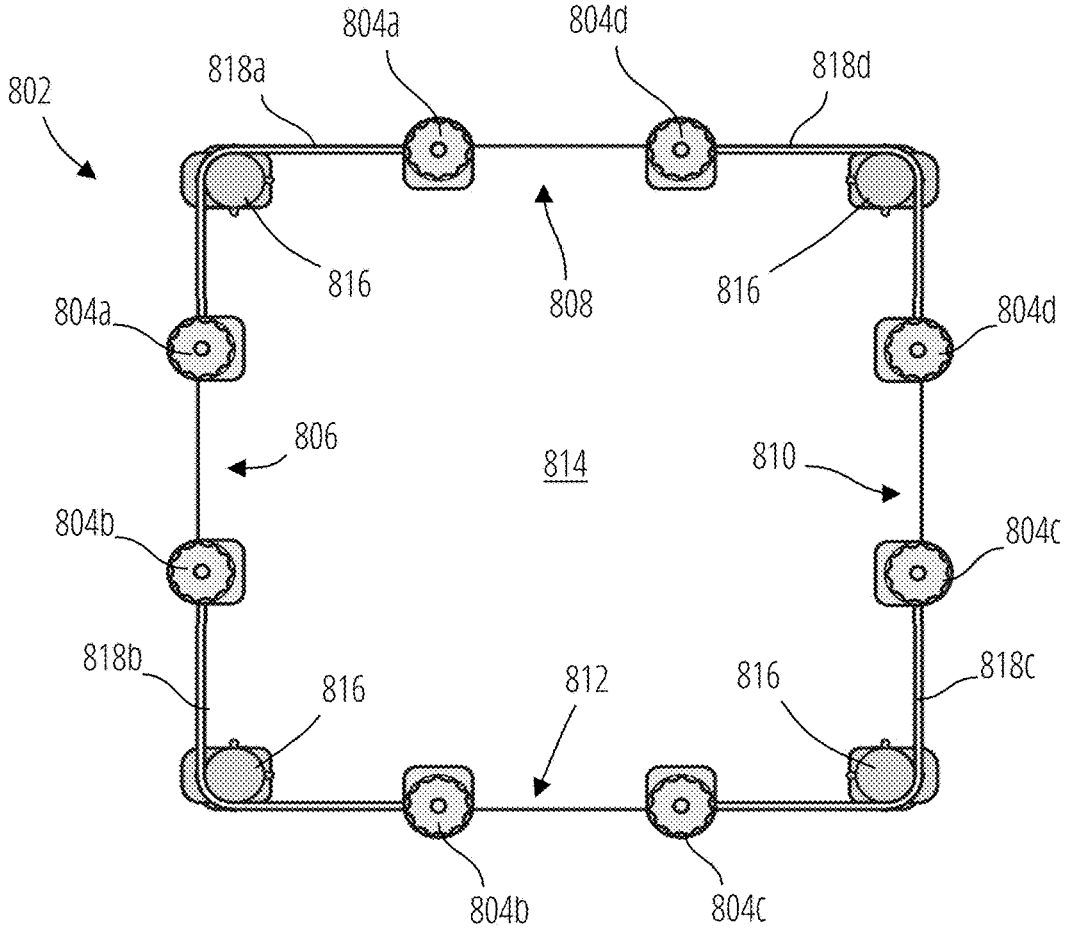
FIG. 8 is a top view of the portable stadium system in a configuration comprising four net assemblies, in accordance with one embodiment.

While most of the example have shown two net assemblies, any number of net assemblies may be used to define the play area. FIG. 8 provides an example of a portable table stadium system 802 comprising more than two net assemblies, in accordance with one embodiment. In this example, four net assemblies (comprising four pairs of goal posts 804*a*, 804*b*, 804*c* and 804*d*) are used to create four goal areas (806, 808, 810, and 812) over a square table surface 814. Four support posts 816 are used to each support a different net (818*a*, 818*b*, 818*c* and 818*d*). It will be appreciated that any number of pairs of goal posts may be used to create correspondingly two or more goal areas, without limitation.

Figure 9:
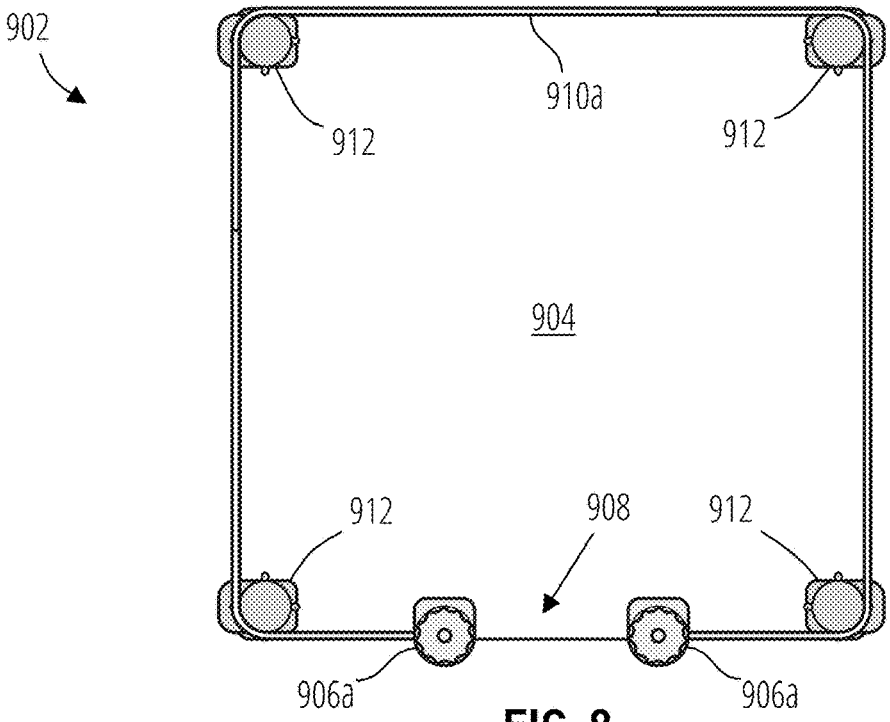
FIG. 9 is a top view of the portable stadium system in a configuration comprising a single net assembly, in accordance with one embodiment.

In some embodiments, a single net assembly may be used. FIG. 9 provides such an exemplary embodiment of a portable table stadium system 902 comprising a single net assembly installed on a square table 904. The net assembly comprises two goal posts 906*a* defining a single goal area 908, and the net 910*a* therebetween is supported by at least four support posts 912.

Figure 10:
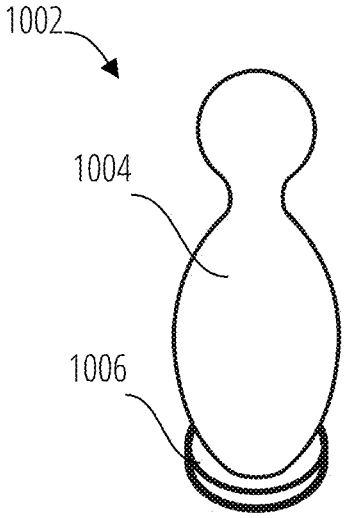
FIG. 10 and FIG. 11 are front views of a bowling pin, in accordance with different embodiments.

FIG. 10 shows an example of a bowling pin accessory 1002, in accordance with one embodiment. In this example, the bowling pin accessory 1002 comprises a body 1004 made of a rigid and light material. The bowling pins are meant to be knocked over so should not be too heavy. In this example, the body 1004 is removably attached to a support disk 1006 which increases the pin's resistance to being knocked over. Different sizes of the support disk 1006 may be used, to provide various levels of resistance.

Figure 11:
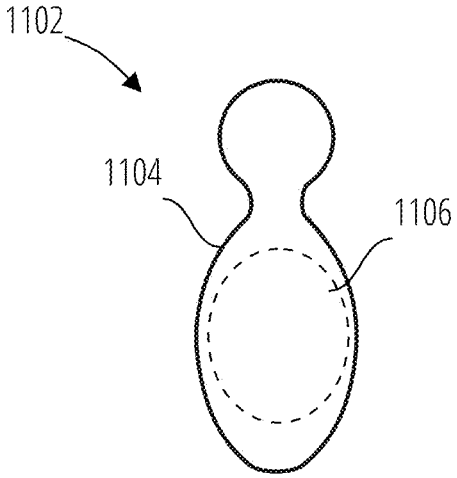

FIG. 11 illustrates another embodiment of a bowling pin 1102. In this example, the bowling pin's body 1104 comprises an internal cavity 1106 that can be filled with various amounts of liquid or other material (such as sand or the like), thereby increasing its resistance to being knocked over.

Figure 12:
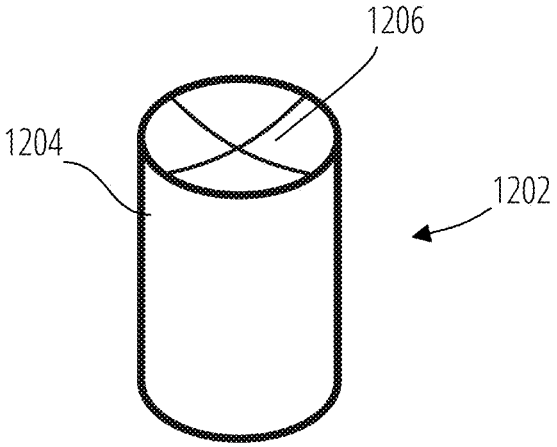
FIG. 12 is top perspective view of an obstacle accessory, in accordance with one embodiment.

FIG. 12 shows an exemplary obstacle accessory 1202, in accordance with one embodiment. In this example, the obstacle comprises a substantially cylindrical body 1204 as an example only, and other shapes may be considered as well. The obstacle accessory 1202 should be made of a rigid material and weight enough so as to not being knocked over or displaced when impacted by a ball (such as ball 120 in FIG. 1). However, the obstacle accessory 1202 should not weigh too much so as to be easily moved or displaced by the users on the table surface. In this example of FIG. 1, it obstructs shots and acts as a deterrent for direct shots from long distances and encourages angles and net shots to be taken to bounce the ball around the stadium. In some embodiments, the obstacle accessory comprises a concave surface 1206 on its top end, which can be used to hold the ball when not in use.

While the present disclosure describes various embodiments for illustrative purposes, such description is not intended to be limited to such embodiments. On the contrary, the applicant's teachings described and illustrated herein encompass various alternatives, modifications, and equivalents, without departing from the embodiments, the general scope of which is defined in the appended claims. Information as herein shown and described in detail is fully capable of attaining the above-described object of the present disclosure, the presently preferred embodiment of the present disclosure, and is, thus, representative of the subject matter which is broadly contemplated by the present disclosure.

What is claimed is:

1. A portable stadium system comprising:

one or more net assemblies, each net assembly comprising:

a first goal post and a second goal post, each goal post configured to be removably secured to a table;

a net coupled at a first end thereof to said first goal post, and at a second end thereof to a second goal post and extending therebetween; and at least one support post per net assembly, each support post configured to be removably secured to said table and disposed as to engage with the net of one of said one or more net assemblies to provide vertical support thereto and to define at least in part an enclosed space on said table; and wherein each support post comprises a substantially elongated body comprising a plurality of protrusions extending laterally therefrom for engaging with one or more holes in said net.

2. The portable stadium system of claim 1, wherein at least one of said first goal post or second goal post comprises a tensioning mechanism configured to vary a length of said net therebetween.

3. The portable stadium system of claim 2, wherein said tensioning mechanism comprises a reel for coiling said net therearound, the reel coupled to a tensioning wheel.

4. The portable stadium system of claim 2, wherein at least of said first goal post or second goal post is removably attached to said net.

5. The portable stadium system of claim 1, wherein said substantially elongated body of said support post is configured to be rotatable around an axis defined by a length thereof.

6. The portable stadium system of claim 1, wherein said support post comprises a clamping portion and wherein said substantially elongated body is offset with respect to said clamping portion so as to be above a surface of said table upon the support post being removably secured.

7. The portable stadium system of claim 1, comprising two or more net assemblies; and wherein each net assembly of said two or more net assemblies has one goal post of said first or second goal post disposed proximate another goal post of said first or second goal post of another net assembly of said two or more net assemblies, thereby defining a goal area therebetween.

8. The portable stadium system of claim 7, comprising three or more net assemblies, thereby defining correspondingly three or more goal areas.

9. The portable stadium system of claim 7, further comprising:

a cross-bar having a substantially elongated body, and configured to be removably coupled at a first end thereof to an upper portion said one goal post and at a second end thereof to an upper portion of said another goal post.

10. The portable stadium system of claim 9, wherein the cross-bar is extensible.

11. The portable stadium system of claim 9, wherein the cross-bar comprises a scoring tracker.

12. The portable stadium system of claim 9, further comprising:

a rigid frame attachable to the cross-bar and defining a goal volume; and a stretchable goal net coupled to said cross-bar and rigid frame enclosing said goal volume.

13. The portable stadium system of claim 1, comprising a single net assembly, thereby defining correspondingly a single goal area between said first goal post and said second goal post.

14. The portable stadium system of claim 1, further comprising:

one or more bowling pin accessories; and at least one obstacle accessory.

15. The portable stadium system of claim 14, wherein at least one of said one or more bowling pin accessories is configured to have a resistance to being knocked down upon being impacted modified.

16. The portable of claim 15, wherein said resistance to being knocked down is changed by attaching a support disk at the bottom thereof.

17. The portable of claim 14, wherein said at least one of said one or more bowling pin accessories comprises an internal cavity, wherein said resistance to being knocked down is modified by filing said cavity with a material.

18. The portable of claim 14, wherein said at least one obstacle accessory is substantially cylindrically shaped and comprises a concave top surface.

* * * * *